US009863150B2

(12) United States Patent
Lenney

(10) Patent No.: US 9,863,150 B2
(45) Date of Patent: Jan. 9, 2018

(54) GUTTER GUARD EXTENSION

(71) Applicant: GutterGlove, Inc., Rocklin, CA (US)

(72) Inventor: Robert C. Lenney, Lincoln, CA (US)

(73) Assignee: GUTTERGLOVE, INC., Roseville, CA (US)

( * ) Notice: Subject to any disclaimer, the term of this patent is extended or adjusted under 35 U.S.C. 154(b) by 0 days.

(21) Appl. No.: 15/410,661

(22) Filed: Jan. 19, 2017

(65) Prior Publication Data

US 2017/0204612 A1 Jul. 20, 2017

Related U.S. Application Data

(60) Provisional application No. 62/280,440, filed on Jan. 19, 2016.

(51) Int. Cl.
*E04H 3/12* (2006.01)
*E04D 13/076* (2006.01)

(52) U.S. Cl.
CPC ..... *E04D 13/076* (2013.01)

(58) Field of Classification Search
CPC ..... E04D 13/076; E04D 13/064
USPC ..... 52/12
See application file for complete search history.

(56) References Cited

U.S. PATENT DOCUMENTS 4,959,932 A * 10/1990 Pfeifer ..... E04D 13/076 52/12
5,848,857 A * 12/1998 Killworth ..... E04D 13/076 210/474
2005/0204642 A1* 9/2005 Valentini ..... E04D 13/076 52/12
2006/0179723 A1* 8/2006 Robins ..... E04D 13/076 52/11
2007/0017162 A1* 1/2007 Staub ..... E04D 13/076 52/11
2010/0071273 A1* 3/2010 Joly, Jr. ..... E04D 13/076 52/12
2011/0056145 A1* 3/2011 Lenney ..... E04D 13/076 52/12
2011/0067318 A1* 3/2011 Lenney ..... E04D 13/076 52/12
2012/0110923 A1* 5/2012 Robins ..... E04D 13/076 52/12
2013/0160377 A1* 6/2013 Sager ..... E04D 13/002 52/12

(Continued)

*Primary Examiner* — Brian D Mattei
(74) *Attorney, Agent, or Firm* — Jonathan A. Kidney; CKR Law

(57) ABSTRACT

An extendable, debris and leaf precluding gutter cover with a gutter lip end and an opposing roof-side end, has a fixed, non-adjustable width, wherein the roof-side end is shaped with a mating feature to a corresponding end. A weather resistant, debris and leaf precluding, low-profile gutter cover extension is matched to the gutter cover, having a roof end and the corresponding end with a complementary shape to the gutter cover's shaped end's mating feature. This permits joining the ends to maintain a debris and leaf precluding barrier between the gutter cover and extension. When the gutter cover and extension are mated, they form an extendable gutter cover that entirely covers and is self-supporting over the roof's gutter top and a junction of the gutter cover and extension is low-profile, to permit debris flow across a top of the junction.

15 Claims, 5 Drawing Sheets

(56) References Cited

U.S. PATENT DOCUMENTS

| | | | | |
|---|---|---|---|---|
| 2014/0069029 | A1* | 3/2014 | Reese | E04D 13/076<br>52/12 |
| 2015/0225959 | A1* | 8/2015 | Lenney | E04D 13/064<br>52/12 |
| 2017/0058531 | A1* | 3/2017 | Brochu | E04D 13/0767 |

* cited by examiner

GUTTER GUARD EXTENSION

CROSS-REFERENCE TO RELATED APPLICATION(S)

This application claims the benefit of U.S. Provisional Patent Application No. 62/280,440, filed Jan. 19, 2016, the contents of which are hereby incorporated by reference in its entirety.

FIELD

This invention relates to rain gutters and similar structures for keeping leaves and other debris out of rain gutters. More particularly, this invention relates to an extension system to a fixed sized gutter guard for fitment into larger gutters.

BACKGROUND

In today's gutter protection technology, a gutter guard size is matched to a corresponding gutter size. For example, for a six inch gutter, a gutter guard that is slightly wider than 6 inches (so as to span onto the roof) is required. Gutter guards, also known as gutter covers and gutter protection systems, are installed on top of rain gutters that are attached to the edge, or near the edge of a roof-line for keeping leaves, pine needles and other organic debris out of the gutter.

Conventional gutter guards are water permeable, weather resistant and have predetermined widths for fitting different size gutters, thus for a particular gutter, an equivalently sized guard is required. Typical gutter widths at the top opening mouth of the gutter are 4 inches, 5 inches or 6 inches. Commercial grade gutters are generally wider than 6 inches. The difficulty with having a predetermined sized gutter guard for each sized gutter, is that there are significant costs in manufacturing all the appropriate sizes and the concomitant need for additional space for stocking the various sizes. Similarly, various box sizes for packaging each gutter guard for shipping is required.

In view of the prior art approach described above, various systems and methods are detailed below that allow for robust fitment of a extension to smaller gutter guards to fit larger gutters.

SUMMARY

The following presents a simplified summary in order to provide a basic understanding of some aspects of the claimed subject matter. This summary is not an extensive overview, and is not intended to identify key/critical elements or to delineate the scope of the claimed subject matter. Its purpose is to present some concepts in a simplified form as a prelude to the more detailed description that is presented later.

In one aspect of the disclosed embodiments, a size-adjustable debris preclusion device for securing to a top of a roof gutter attached to a building for keeping leaves and other debris out of the roof gutter is provided, comprising: a debris and leaf precluding gutter cover with a gutter lip end and an opposing roof-side end, sized to cover at least one of a portion of and all of a longitudinal section of a roof gutter's top, the cover having a fixed, non-adjustable width, wherein the roof-side end is shaped with a mating feature to a corresponding end; and a debris and leaf precluding, low-profile gutter cover extension having a roof end and the corresponding end, the corresponding end having a complementary shape to the gutter cover's shaped end's mating feature, so as to permit a joining of the ends to maintain a debris and leaf precluding barrier between the gutter cover and extension, wherein, when the gutter cover and extension are mated, form an extended gutter cover that entirely covers and is self-supporting over the roof's gutter top and a junction of the gutter cover and extension is low-profile, to permit water flow across a top of the junction.

In another aspect of the disclosed embodiments, the above device is provided, further comprising a screw or adhesive disposed into or between the cover's mating feature and extension's complementary shape; and/or wherein the mating feature has a shape of at least one or more fingers with one or more short protrusions extending from the one or more fingers, wherein the protrusion operate to lock the finger into or onto the extension's complementary shape; and/or wherein a shape of the roof end of the extension is opposite the complementary shape, so as to permit joining of another extension to the roof end of the extension; and/or further comprising one or more longitudinal markings along a top surface of the extension, indicating a distance or approximate gutter size; and/or wherein the longitudinal markings are shaped as troughs to fit a protrusion; and/or wherein the complementary shape of the extension further includes a bottom supporting foot, extending downward; and/or wherein the extension is in the form of an L with an upper substantially vertical portion and lower substantially horizontal portion is roof-side, wherein the horizontal portion includes the complementary shape; and/or wherein the upper portion has a bent portion adapted to rest on a roof end; and/or wherein the bent portion operates as a drip edge; and/or further comprising a gutter; and/or the extension is formed from a metal or plastic; and/or wherein at least one of the gutter cover and extension is weather resistant; and/or wherein the gutter cover is water permeable.

In another aspect of the disclosed embodiments, a debris preclusion extension device for attachment to a gutter cover secured to a top of a roof gutter attached to a building for keeping leaves and other debris out of the roof gutter is provided, comprising: a debris and leaf precluding, low-profile gutter cover extension having a roof side end and a gutter cover side mating end, the mating end having a shape that is configured to attach to a gutter cover's roof-side end and shaped to permit a joining of the ends to maintain a low profile over a junction between the gutter cover and the extension.

In yet another aspect of the disclosed embodiments, a method for precluding leaf and other debris from entering a roof gutter that is attached to a building is provided, comprising: forming a debris and leaf precluding, gutter cover with a gutter lip end and an opposing roof-side end, wherein the roof-side end is shaped with a mating feature to a corresponding end; forming a debris and leaf precluding, low-profile gutter cover extension having a roof end and the corresponding end, the corresponding end having a complementary shape to the gutter cover's shaped end's mating feature; joining the gutter cover with the extension by inserting the cover's roof-side shaped end into the extension's corresponding end, to maintain a debris and leaf precluding barrier between the gutter cover and extension; and securing the joined gutter cover and extension over a gutter, with the extension's roof end placed under a roof covering.

In yet another aspect of the disclosed embodiments, the method above is provided, further comprising joining an additional extension to the extension to cover the gutter.

DETAILED DESCRIPTION

In various embodiments, a Gutter Guard Extension is described with a low profile, that they can be shipped in the same box as a standard gutter guard. This, of course, allows one to have a single sized gutter guard for multiple gutter sizes. This reduces product cost since less different-sized gutter guards are required, reduces shipping costs since only a single-sized box can be used, all of which reduces storage costs.

The exemplary extensions allow the mating gutter guard to slide under the roof shingles or to fasten it along the back of the gutter, in accordance with typical mounting procedures. Depending on the gutter-to-roof scenario, various extension shapes would be used. The exemplary extensions can also be designed to protrude down from the gutter guard to the bottom of the gutter to assist in supporting the gutter guard for larger size commercial grade gutters, which typically span a gutter width of greater than 6 inches.

The exemplary extensions can be made out of aluminum, steel, copper or other metals and even plastics. The materials can be molded or extruded into the shape of the extension needed or the use of a press (or other piece of bending metal equipment) to bend the material into the shape of the extension desired. The exemplary extensions can be "solid" or permeable, mesh-like or any combination thereof. The exemplary extensions can be weather resistant and/or water permeable, if so desired.

The exemplary embodiments overcome the deficiencies in the prior art via the utilization of an extension accessory that attaches to the roof-side edge of a gutter guard to lengthen it (adjust its size) so it can fit a larger gutter. By lengthening a fixed size gutter guard with the extension, there is no need to fabricate a separate full size gutter guard for spanning the larger gutter. As an example, most standard size gutter guards are approximately 5.5 inches in width and will fit a 5 inch gutter or smaller, but will not fit a larger size 6 inch gutter. By coupling or fixing an extension on the "back" of the 5.5 inch gutter guard, it can now become 6.5 inches, for example, in length for fitment to a 6 inch wide gutter. Additionally, the mating structures described herein avoid significant vertical protrusions of the extension-to-gutter guard connection, so as to minimize the obstruction and/or retention of debris that may travel from the roof to the gutter guard.

Figure 1A:
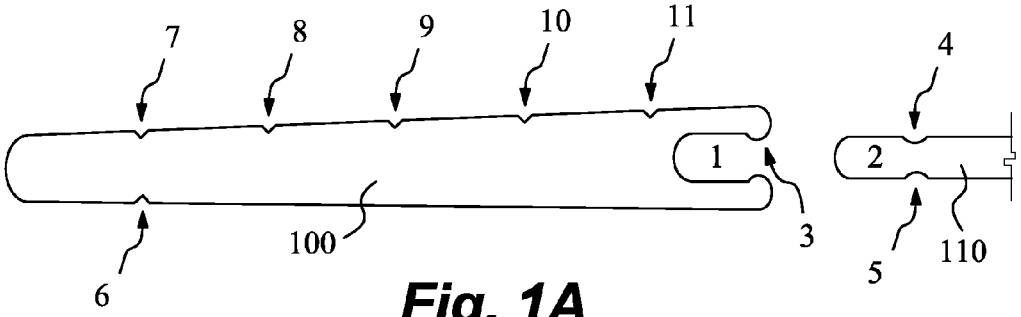
FIG. 1A is a side view illustration of an exemplary extension and roof-side end section of a gutter guard.

FIG. 1A is a side view illustration of an exemplary extension 100 and roof-side end section 2 of gutter guard 110. The extension 100 has a mouth or opening 1 that is shaped to mate to the roof-side end 2 of gutter guard 110. The front of the mouth 1 has at least one tooth or protrusion 3, (shown here, in this example, with upper and lower protrusion), which allows the extension 100 to be interlocked onto the gutter guard end's 2 receiving trough(s) or receptacle(s) 4 (shown here with an opposite receptacle 5). With sufficient rigidity of the constituent end 2 and mouth 1 material, this mating method works very well enough to allow, for example, a "snapping" in of the pieces. Of course, in various other embodiments, the joining fitment can be via any structure or mechanism that allows the ends to be secured fixed to each other. For example, in some embodiments, the pieces can be joined by laterally sliding the pieces into each other, or via a twisting or other action.

FIG. 1A's extension 100 also contains a similar configuration of receptacle(s) 7 and 6 at a distal end, to accommodate another extension (not shown) to be attached to the distal end of the extension 100. Thus, several extensions may be joined end-to-end to provide the desired width. It should be apparent, that with this design, various prior art approaches utilizing fastening tools, adhesives, mechanical fasteners (screws, rivets, etc.) are not needed to span gutters that have widths of 6 inches and greater.

Troughs 8, 9, 10 and 11 are optional (running a length or partial length) and if used can be spaced as measurement guides. As an example, they could be spaced 0.25 inches apart. (Of course, other spacings are possible and fully within the purview of this disclosure.) This can help the installer understand dimensions more quickly in certain applications.

In view of the embodiment shown in FIG. 1A, it should be understood that various modifications and alterations to the end shape and matting end shape of the pieces can be made, while providing a similar or equivalent result without departing from the spirit of this disclosure.

Figure 1B:
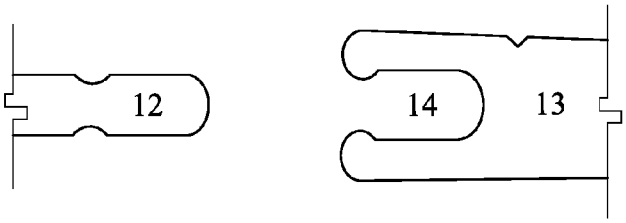
FIG. 1B is a side view of a reversal of the shapes shown in FIG. 1A.

For example, FIG. 1B is a side view of a reversal of the shapes shown in FIG. 1A. That is, extension 12 has a tongue or finger that is similar to FIG. 1A's gutter guard end 2, which is mated to gutter guard 13 with mating mouth opening 14 (corresponding to FIG. 1A's extension's 100 mouth 1).

Figure 1C:
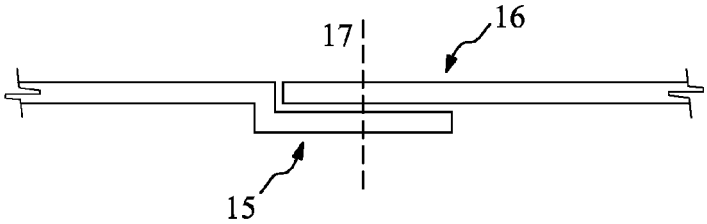
FIG. 1C is an illustration of another embodiment showing an extension with lower lip and matching gutter guard end.

FIG. 1C is an illustration of another embodiment showing an extension with lower lip 15 and matching gutter guard end 16 that connects together by the use of a screw, bolt or other type of fastener 17. Instead of interlocking together, gutter guard end 16 lays on top of extension lip 15, or visa versa. It should be apparent that the top surface of the interface between the two pieces is fairly unobstructed, thus allowing easy flow of debris from the extension to the gutter guard. Thus, a low profile design is shown herein.

It should also be appreciated that while the various embodiments shown here for the extension illustrate a "solid" surface, it is understood that the extension may be non-solid, water permeable so as to act as a debris and leaf precluding structure. That is, the extension may be designed to operate also with gutter guard like features, in tandem with the adjoining gutter guard. Thus, it is understood that the shapes, material, design, structure of the extension may be varied as according to design preference, without departing from the spirit and scope of this disclosure.

It should be apparent that the exemplary design can be modified or changed, if so desired, to allow an exemplary extension 100 to be end-mounted to or attached to a gutter guard 110 that does not have the shaped end 2 shown in the above FIGS. That is, it is fully envisioned the exemplary extension 100 can be modified with a generic opening that is tailored to fit over a conventional gutter guard's end. Therefore, any mechanism or design that allows an extension to be "attached" to the end of a gutter guard (whether specifically designed for the extension or designed without any considerations for an extension) is understood to be within the spirit and scope of this disclosure.

Figure 1D:
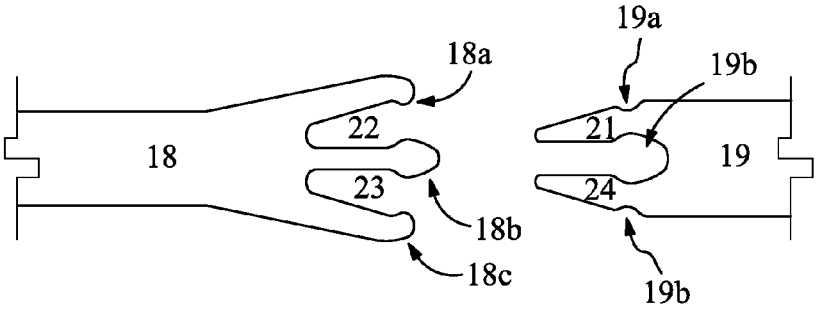
FIG. 1D is a side view of ends of extension and gutter guard, having a plurality of interlocking structures.

FIG. 1D is a side view of ends of extension 18 and gutter guard 19, having a plurality of interlocking structures. This embodiment is similar to FIG. 1A's but with multiple mating tongues or fingers. Extension 18 is shown with three fingers with protrusions 18*a*, 18*b*, and 18*c* with voids 22 and 23 therebetween. The voids 22, 23 of extension 18 match with gutter guard's 19 interstitial fingers 21 and 24 and "lock" into each other, aided by protrusions 18*a*, 18*b*, 18*c* fitting into gutter guard's 19 receptacles 19*a*, 19*b*, 19*c*. Of course, a reversal of the structures may be implemented, if so desired. Additionally, more or less protrusions and voids, shapes, etc. may be implemented.

Depending the shape, length, type of material used, the amount of force to require locking may vary. Further, the term lock here, or locking is understood to indicate that the interlocked ends are secured to each other and will not easily "slip" out once engaged, and may require significant effort or twisting to unlock the ends. Of course, the number of shapes, the kind of shapes, lengths, direction, etc. of the tongues or fingers, extensions, voids, receptacles may differ from what is shown and is understood to be within the scope of one of ordinary skill in the art.

Figure 2A:
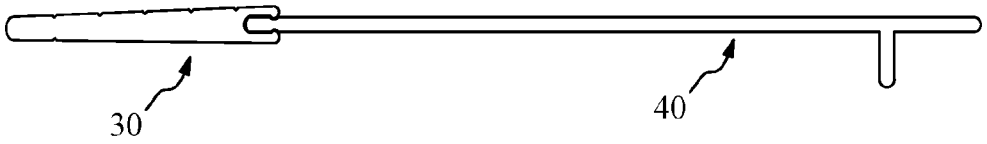
FIG. 2A is an illustration showing a complete side view of an exemplary extension attached to a gutter guard.

FIG. 2A is an illustration showing a complete side view of an exemplary extension 30 attached to a gutter guard 40, and is understood to be self-explanatory.

Figure 2B:
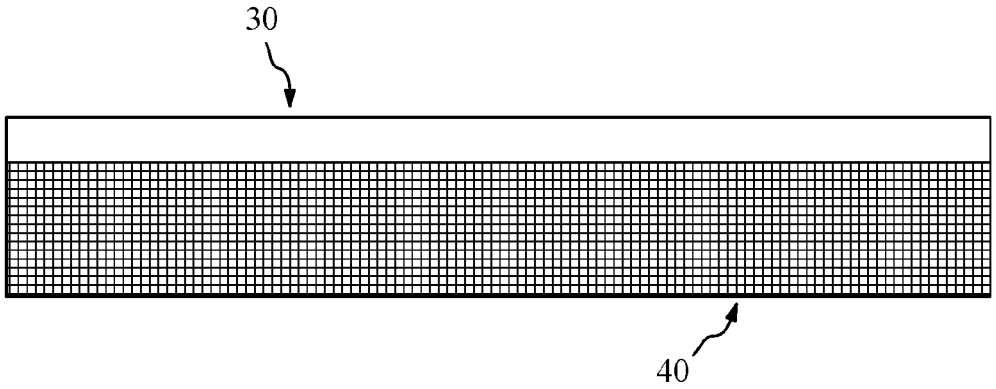
FIG. 2B is an illustration showing a top view of an exemplary extension attached to a gutter guard.

FIG. 2B is an illustration showing a top view of an exemplary extension 30 attached to gutter guard 40. Here, the extension 30 is shown as being solid, though it is understood that it is not a requirement. While FIG. 2B shows a mesh-like gutter guard 40, any shape, design, form for the gutter guard 40 may be utilized. Aspects of this illustration and embodiment are understood to be self-explanatory.

Figure 3:
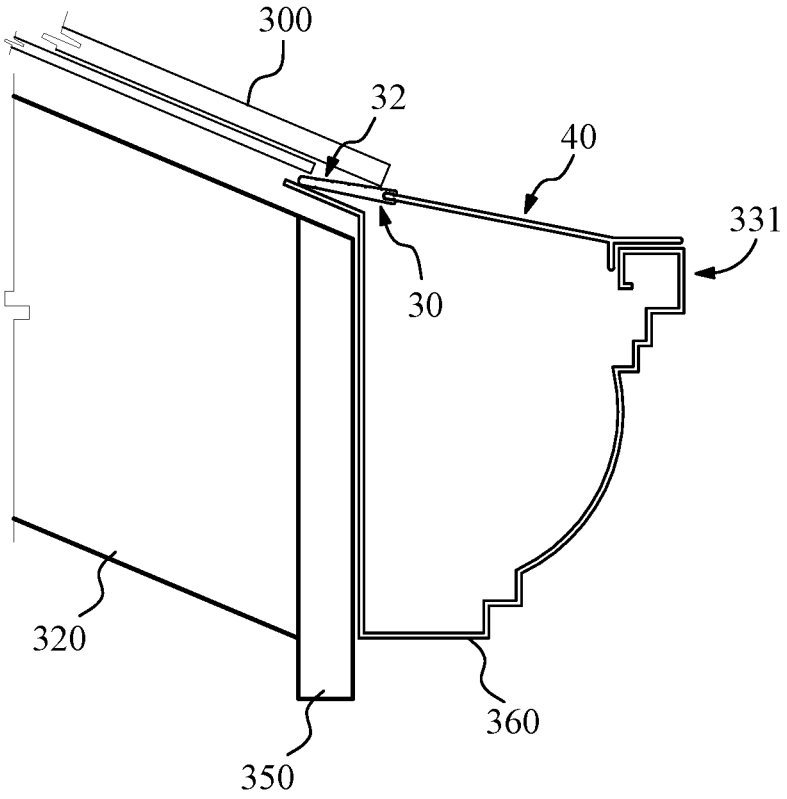
FIG. 3 is a side view illustration of a roof gutter with exemplary gutter guard system attached.

FIG. 3 is a side view illustration of a roof gutter 360 with exemplary gutter guard system attached. Gutter 360 is mounted to a fascia board 350 connected to the roof 330 and rafter 320. The gutter's 360 opening is covered with gutter guard 40 (overlapping the gutter's front lip 331) that is of insufficient length to cover the gutter's opening, but is bridged to the roof edge 32 via exemplary extension 30 mated to a roof-side end of the gutter guard 40. The extension 30 allows the gutter guard 40 to fully span from the front lip of the gutter 331 to the upper roof edge 32.

Figure 4:
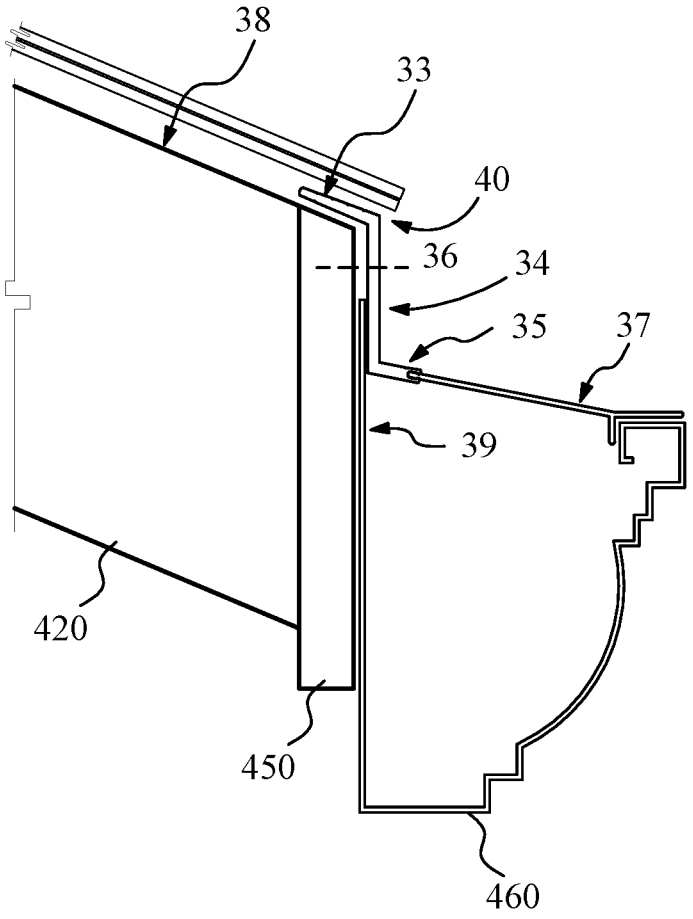
FIG. 4 is a side view illustration of a gutter guard system that is a variation of the system shown in FIG. 3.

FIG. 4 is a side view illustration of a gutter guard system that is a variation of the system shown in FIG. 3. In this embodiment, the gutter guard extension 34 is formed into a bent L shape with an upper lip 33 that fits over the fascia 450 or on the roof 38 (below shingles), with a lower "horizontally" oriented portion 35 that has a matting end to interlock into gutter guard 37. Extension 34 rides into the fascia-side back edge 39 of gutter 460, which is attached to fascia 450. This extension type can fasten to the fascia 450 or rafter 420 by the use of a screw or nail 36. As can be seen, this embodiment contemplates a gutter 460 that is mounted at a "lower" point of the roof end than the gutter shown in FIG. 3.

The extension surfaces 33, 34 and 35 can also be used as a drip edge barrier so rainwater does not travel up the roof-line. In this configuration, the back edge 39 of the gutter 460 does not reach the top of the roof edge 40, so a drip edge material is appropriate. In this scenario the exemplary extension serves two purposes, it functionally extends the gutter guard 37 to span the top of the gutter 460 to the roof 38 and also acts as a drip edge barrier. A drip edge is often used by roofers or gutter installers when there is a gap of exposed wood (the roof sheeting or fascia 450), where rainwater can leak back. The drip edge prevents rainwater from leaching back into the home and prevents the fascia's wood from rotting.

If the roofing material is a heavy covering, like a concrete tile, or stiff (such as terra cotta, etc.), it cannot be easily lifted up from the fascia to slide an extension 33 lip under it. In this scenario, the extension's lip 33 would not be part of the extension 34. That is, the extension would be composed of surfaces 34 and 35, only. In some embodiments, lip 33 would be cut or removed from the extension, or the extension itself would only be fabricated with surfaces 34 and 35.

Various modifications may be made, for example, it some embodiments, the extension may be formed from a stronger or stiffer material so as to act as a better supporting structure for the gutter guard. That is, the gutter guard may only be stiff enough for a gutter that it is sized for, and an attempt to use a larger gutter guard will necessitate a different type or material for the gutter guard (as it must be supported over a longer span, otherwise it will collapse into the gutter). In these situations, the extension may provide the necessary stiffness to span the larger gutter without requiring a different (material) gutter guard.

Figure 5:
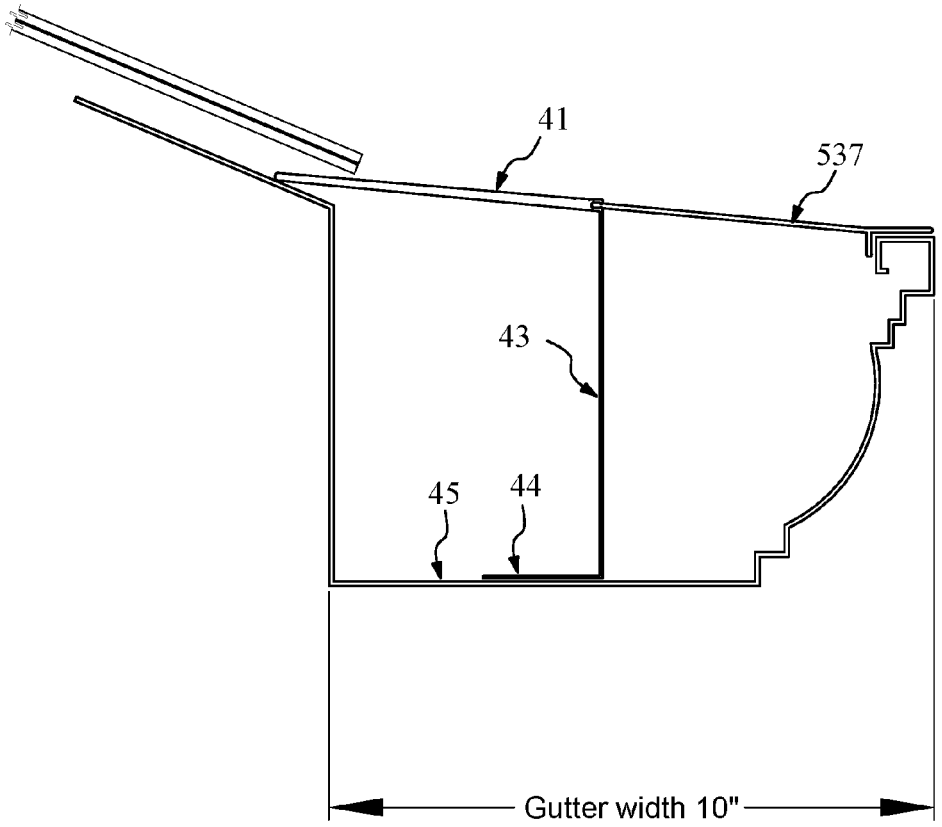
FIG. 5 is a side view illustration showing another embodiment, wherein the gutter is very wide

FIG. 5 is a side view illustration showing another embodiment, wherein the gutter 45 is very wide (for example, 10 inches wide). Here, an exemplary extension 41 "supports" itself and the gutter guard 537 via a downward leg support 43 that rests on the bottom of the gutter 45. The bottom of downward leg 43 has a foot 44 that rests on the bottom of the gutter 45. An adhesive or sealant can be used to help secure the foot 44 to the bottom of the gutter 45, if necessary.

It should be understood that while cross-sectional views are presented herein, with features relating to the fingers, extensions, troughs, etc. as part of the cross section, the features described may be limited, in some embodiments, to certain lengths or sections of the gutter guard and extension. That is, it is fully envisioned that one or more of the exemplary features may occur at intervals along an entire length of the extension or cover. It is also envisioned that neighboring gutter guards (at their terminal sides) may be bridged with a single extension to provide an "independent" support, and one or more of the exemplary features may be adapted, changed, modified to better strengthen these terminal side junctions. As a non-limiting example, ends of the terminal side junctions may have a plurality of fingers while mid-sections of the gutter guards have a singular finger configuration.

While various aspects and embodiments have been disclosed herein, other aspects and embodiments will be apparent to those skilled in the art. Therefore, various modifications to the shape and design of the embodiments disclosed, which provide similar functionalities are understood to be within the spirit and scope of this disclosure. The various aspects and embodiments disclosed herein are for purposes of illustration and are not intended to be limiting, with the true scope being indicated by the following claims.

What is claimed is:

1. A size-adjustable debris preclusion device for securing to a top of a roof gutter attached to a building for keeping leaves and other debris out of the roof gutter, comprising:

a debris and leaf precluding gutter cover with a gutter lip end and an opposing roof-side end, sized to cover at least one of a portion of and all of a longitudinal section of a roof gutter's top, the cover having a fixed, non-adjustable width, wherein the roof-side end is shaped with a mating feature to a corresponding end; and a debris and leaf precluding, low-profile gutter cover extension having a roof end and the corresponding end, the corresponding end having a complementary shape to the gutter cover's shaped end's mating feature, so as to permit a joining of the ends to maintain a debris and leaf precluding barrier between the gutter cover and extension, the complementary shape having at least one or more fingers with one or more short protrusions extending from the one or more fingers, the protrusion(s) operating to lock the finger into or onto a corresponding receiving receptacle(s) in the cover's mating feature, wherein, when the gutter cover and extension are mated, form an extended gutter cover that entirely covers and is self-supporting over the roof's gutter top and a junction of the gutter cover and extension is low-profile, to permit water flow across a top of the junction.

2. The device of claim 1, further comprising a screw or adhesive disposed into or between the cover's mating feature and extension's complementary shape.

3. The device of claim 1, wherein a shape of the roof end of the extension is opposite the complementary shape, so as to permit joining of another extension to the roof end of the extension.

4. The device of claim 1, further comprising one or more longitudinal markings along a top surface of the extension, indicating a distance or approximate gutter size.

5. The device of claim 4, wherein the longitudinal markings are shaped as troughs to fit a protrusion.

6. The device of claim 1, wherein the complementary shape of the extension further includes a bottom supporting foot, extending downward.

7. The device of claim 1, wherein the extension is in the form of air L with an upper substantially vertical portion and lower substantially horizontal portion, wherein the horizontal portion includes the complementary shape.

8. The device of claim 7, wherein the upper portion has a bent portion adapted to rest on a roof end.

9. The device of claim 8, wherein the bent portion operates as a drip edge.

10. The device of claim 1, further comprising a gutter.

11. The device of claim 1, wherein the extension is formed from a metal or plastic.

12. The device of claim 1, wherein at least one of the gutter cover and extension is weather resistant.

13. The device of claim 1, wherein the gutter cover is water permeable.

14. A method for precluding leaf and other debris from entering a roof gutter that is attached to a building, comprising:

forming a debris and leaf precluding, gutter cover with a gutter lip end and an opposing roof-side end, wherein the roof-side end is shaped with a mating feature to a corresponding end and the mating feature includes one or more protrusion receptacle(s);

forming a low-profile gutter cover extension having a roof end and the corresponding end, the corresponding end having a complementary shape to the gutter cover's shaped end's mating feature and also having at least one finger with one or more protrusions to fit into or onto the cover's protrusion receptacle(s);

joining the gutter cover with the extension by inserting the cover's roof-side shaped end into the extension's corresponding end, to maintain a debris and leaf precluding barrier between the gutter cover and extension; and securing the joined gutter cover and extension over a gutter, with the extension's roof end placed under a roof covering.

15. The method of claim 14, further comprising joining an additional extension to the extension to cover the gutter.

* * * * *